US006746327B2

(12) United States Patent
Frohm et al.

(10) Patent No.: US 6,746,327 B2
(45) **Date of Patent: *Jun. 8, 2004**

(54) GAMING MACHINE WITH PLAYER SELECTED EVENTS

(75) Inventors: Erica A. Frohm, Evanston, IL (US); John J. Giobbi, Crown Point, IN (US); Damon E. Gura, Chicago, IL (US); Joel R. Jaffe, Evanston, IL (US); Marc A. Raneses, Elk Grove Village, IL (US)

(73) Assignee: WMS Gaming Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/430,839

(22) Filed: May 6, 2003

(65) Prior Publication Data

US 2003/0195029 A1 Oct. 16, 2003

Related U.S. Application Data

(63) Continuation of application No. 09/538,934, filed on Mar. 31, 2000, now Pat. No. 6,592,457, which is a continuation-in-part of application No. 09/393,492, filed on Sep. 10, 1999, now Pat. No. 6,270,411, and a continuation-in-part of application No. 09/318,903, filed on May 26, 1999, now Pat. No. 6,443,837.

(51) Int. Cl.[7] ..... A63F 9/24

(52) U.S. Cl. ..... 463/16; 273/138.1

(58) Field of Search ..... 463/1–4, 6, 8, 463/16–20, 22, 25–26, 30–31, 36–37, 40, 43–44; 273/108.1, 108.3, 277, 138.1, 139, 143 R, 274, 317.1, 317.3–317.6, 461

(56) References Cited

U.S. PATENT DOCUMENTS

| | | | | |
|---|---|---|---|---|
| 3,281,149 | A | 10/1966 | Miller | 273/143 |
| 4,095,795 | A | 6/1978 | Saxton et al. | 273/143 R |

(List continued on next page.)

FOREIGN PATENT DOCUMENTS

| | | | |
|---|---|---|---|
| DE | 37 00 861 | 7/1988 | G07F/17/32 |
| DE | 40 14 477 | 7/1991 | G07C/15/00 |
| EP | 0 142 371 | 5/1985 | G07F/17/34 |
| EP | 0 148 001 | 7/1985 | G07F/17/34 |
| EP | 0 333 338 | 9/1989 | G07F/17/32 |
| EP | 0 577 415 | 1/1994 | A63F/9/04 |
| FR | 1 474 617 | 3/1967 | |
| GB | 1129607 | 10/1968 | A63F/9/00 |
| GB | 1 476 848 | 6/1977 | G07F/17/34 |
| GB | 1 591 623 | 6/1981 | G07F/17/34 |
| GB | 2 066 991 | 7/1981 | G07F/17/34 |
| GB | 2 072 395 | 9/1981 | G07F/17/34 |
| GB | 2 083 936 | 3/1982 | G07F/17/34 |
| GB | 2 084 371 | 4/1982 | G07F/17/34 |
| GB | 2 096 376 | 10/1982 | G07F/17/34 |

(List continued on next page.)

OTHER PUBLICATIONS

Product Sheet for "Monopoly SWP," JPM Ltd., 4 pages (date unknown).

Product Sheet for "Big Money," WMS Gaming Inc., 1 page (date unknown).

(List continued on next page.)

*Primary Examiner*—Kim Nguyen
(74) *Attorney, Agent, or Firm*—Jenkens & Gilchrist

(57) ABSTRACT

A gaming machine includes a presentation element and an animation feature. In response to a wager amount, a processor controls the presentation element. The presentation element is capable of presenting a plurality of action selections for a player. When a player selects one of the actions, the animation feature animates a multi-step event corresponding to the selected action. Combinations of multi-step events result in a continuing gameplay experience, and payoffs are rewarded to the player in response to certain multi-step events or certain achievements in the continuing gameplay experience.

32 Claims, 5 Drawing Sheets

U.S. PATENT DOCUMENTS

| | | | | |
|---|---|---|---|---|
| 4,306,768 | A | 12/1981 | Egging | 350/174 |
| 4,335,809 | A | 6/1982 | Wain | 194/1 R |
| 4,448,419 | A | 5/1984 | Telnaes | 273/143 R |
| 4,508,345 | A | 4/1985 | Okada | 273/143 R |
| 4,624,459 | A | 11/1986 | Kaufman | 273/143 R |
| 4,721,307 | A | 1/1988 | Okada | 273/143 R |
| 4,763,256 | A | 8/1988 | DeMar | 364/410 |
| 4,772,023 | A | 9/1988 | Okada | 273/143 R |
| 4,805,907 | A | 2/1989 | Hagiwara | 273/138 A |
| 4,871,171 | A | 10/1989 | Rivero | 273/138 A |
| 5,083,785 | A | 1/1992 | Okada | 273/143 R |
| 5,169,147 | A | 12/1992 | Hamano | 273/138 A |
| 5,205,555 | A | 4/1993 | Hamano | 273/143 R |
| 5,259,616 | A | 11/1993 | Bergmann | 273/138 A |
| 5,292,127 | A | 3/1994 | Kelly et al. | 273/138 R |
| 5,342,047 | A | 8/1994 | Heidel et al. | 273/85 CP |
| 5,342,049 | A | 8/1994 | Wichinsky et al. | 271/119 R |
| 5,380,008 | A | 1/1995 | Mathis et al. | 273/143 R |
| 5,386,903 | A | 2/1995 | Rothschild et al. | 194/350 |
| 5,393,057 | A | 2/1995 | Marnell, II | 273/85 CP |
| 5,401,024 | A | 3/1995 | Simunek | 273/138 A |
| 5,415,404 | A | 5/1995 | Joshi et al. | 273/138 A |
| 5,423,541 | A | 6/1995 | Nicastro et al. | 273/143 R |
| 5,429,361 | A | 7/1995 | Raven et al. | 273/138 A |
| 5,431,492 | A | 7/1995 | Rothschild et al. | 312/229 |
| 5,449,173 | A | 9/1995 | Thomas et al. | 273/143 R |
| 5,456,465 | A | 10/1995 | Durham | 273/138 A |
| 5,456,466 | A | 10/1995 | Miles | 273/143 R |
| 5,456,468 | A | 10/1995 | Stringfellow et al. | 273/148 B |
| 5,472,197 | A | 12/1995 | Gwiasda et al. | 273/143 R |
| 5,542,669 | A | 8/1996 | Charron et al. | 463/13 |
| 5,547,192 | A | 8/1996 | Ishibashi | 463/26 |
| 5,558,197 | A | 9/1996 | Rothschild et al. | 194/344 |
| 5,569,084 | A | 10/1996 | Nicastro et al. | 463/20 |
| 5,575,717 | A | 11/1996 | Houriet, Jr. et al. | 463/1 |
| 5,624,119 | A | 4/1997 | Leake | 273/269 |
| 5,647,798 | A | 7/1997 | Falciglia | 463/19 |
| 5,664,781 | A | 9/1997 | Feola | 273/292 |
| 5,683,296 | A | 11/1997 | Rasmussen | 463/20 |
| 5,697,843 | A | 12/1997 | Manship et al. | 463/20 |
| 5,704,835 | A | 1/1998 | Dietz, II | 463/20 |
| 5,722,891 | A | 3/1998 | Inoue | 463/20 |
| 5,769,714 | A | 6/1998 | Wiener et al. | 463/3 |
| 5,779,545 | A | 7/1998 | Berg et al. | 463/22 |
| 5,788,573 | A | 8/1998 | Baerlocher et al. | 463/16 |
| 5,823,874 | A | 10/1998 | Adams | 463/17 |
| 5,848,932 | A | 12/1998 | Adams | 463/20 |
| 5,876,275 | A | 3/1999 | Rasmussen | 453/32 |
| 5,951,397 | A | 9/1999 | Dickinson | 463/36 |
| 5,967,518 | A | 10/1999 | Rowe | 273/317.5 |
| 6,004,207 | A | 12/1999 | Wilson, Jr. et al. | 463/20 |
| 6,007,427 | A | 12/1999 | Wiener et al. | 463/17 |
| 6,059,289 | A | 5/2000 | Vancura | 273/143 R |
| 6,089,976 | A | 7/2000 | Schneider et al. | 463/16 |
| 6,102,394 | A | 8/2000 | Wurz et al. | 273/138.2 |
| 6,117,009 | A | 9/2000 | Yoseloff | 463/20 |
| 6,117,010 | A | 9/2000 | Canterbury et al. | 463/20 |
| 6,129,355 | A | 10/2000 | Hahn et al. | 273/142 R |
| 6,135,885 | A * | 10/2000 | Lermusiaux | 463/20 |
| 6,155,925 | A | 12/2000 | Giobbi et al. | 463/20 |
| 6,159,095 | A | 12/2000 | Frohm et al. | 463/19 |
| 6,159,097 | A | 12/2000 | Gura | 463/20 |
| 6,159,098 | A | 12/2000 | Slomiany et al. | 463/25 |
| 6,165,071 | A | 12/2000 | Weiss | |
| 6,190,255 | B1 | 2/2001 | Thomas et al. | 463/20 |
| 6,203,428 | B1 | 3/2001 | Giobbi et al. | 463/16 |
| 6,203,429 | B1 | 3/2001 | Demar et al. | 463/20 |
| 6,234,897 | B1 | 5/2001 | Frohm et al. | 463/20 |
| 6,254,481 | B1 | 7/2001 | Jaffe | 463/20 |
| 6,270,411 | B1 | 8/2001 | Gura et al. | 463/20 |
| 6,302,791 | B1 | 10/2001 | Frohm et al. | 463/21 |
| 6,315,660 | B1 | 11/2001 | DeMar et al. | 463/16 |
| 6,322,309 | B1 | 11/2001 | Thomas et al. | 413/20 |
| 6,334,612 | B1 | 1/2002 | Wurz et al. | 273/143 R |
| 6,347,996 | B1 | 2/2002 | Gilmore et al. | 463/17 |
| 6,358,147 | B1 | 3/2002 | Jaffe et al. | 463/20 |
| 6,364,314 | B1 | 4/2002 | Canterbury | 273/274 |
| 6,364,766 | B1 | 4/2002 | Anderson et al. | 463/16 |
| 6,420,972 | B1 | 7/2002 | Loose | 340/545.1 |
| 6,428,412 | B1 | 8/2002 | Anderson et al. | 463/9 |
| 6,592,457 | B1 * | 7/2003 | Frohm et al. | 463/16 |

FOREIGN PATENT DOCUMENTS

| | | | |
|---|---|---|---|
| GB | 2 097 160 | 10/1982 | G07F/17/34 |
| GB | 2 105 891 | 3/1983 | G07F/17/34 |
| GB | 2 106 685 | 4/1983 | G07F/17/34 |
| GB | 2 117 952 | 10/1983 | G07F/17/34 |
| GB | 2 147 442 | 5/1985 | G07F/17/34 |
| GB | 2 147 773 | 5/1985 | A63F/9/22 |
| GB | 2 152 262 | 7/1985 | G07F/17/34 |
| GB | 2 153 572 | 8/1985 | G07F/17/34 |
| GB | 2 157 047 | 10/1985 | G07F/17/34 |
| GB | 2 165 385 | 4/1986 | G07F/17/34 |
| GB | 2 170 636 | 8/1986 | G07F/17/34 |
| GB | 2 180 087 | 3/1987 | G07F/17/34 |
| GB | 2 181 589 | 4/1987 | G07F/17/34 |
| GB | 2 183 882 | 6/1987 | G07F/17/34 |
| GB | 2 191 030 | 12/1987 | G07F/17/34 |
| GB | 2 197 974 | 6/1988 | G07F/17/34 |
| GB | 2 202 984 | 10/1988 | G07F/17/34 |
| GB | 2 204 436 | 11/1988 | G07F/17/34 |
| GB | 2 210 191 | 6/1989 | G07F/17/34 |
| GB | 2 222 712 | 3/1990 | G07F/17/34 |
| GB | 2 226 907 | 7/1990 | G07F/17/34 |
| GB | 2 229 565 | 9/1990 | A63F/9/00 |
| GB | 2 230 373 | 10/1990 | G07F/17/34 |
| GB | 2 233 806 | 1/1991 | G07F/17/34 |
| GB | 2 242 300 | 9/1991 | G07F/17/34 |
| GB | 2 253 154 | 9/1992 | A63F/9/04 |
| GB | 2 262 642 | 6/1993 | G07F/17/34 |
| GB | 2 270 787 | 3/1994 | G07F/17/34 |
| GB | 2 273 384 | 8/1994 | G07F/17/34 |
| GB | 2 287 567 | 9/1995 | G07F/17/34 |
| GB | 2 297 857 | 8/1996 | G07F/17/34 |
| GB | 2 298 508 | 9/1996 | G07F/17/34 |
| WO | WO 88/08179 | 10/1988 | G07F/17/34 |
| WO | WO 89/12875 | 12/1989 | G07F/17/32 |
| WO | WO 92/10818 | 6/1992 | G07F/17/32 |
| WO | WO 94/01840 | 1/1994 | G07F/17/34 |

OTHER PUBLICATIONS

Product Sheet for "Piggy Bankin'," WMS Gaming Inc., 1 page (date unknown).

Product Sheet for "Pirate's Thunder," WMS Gaming Inc., 1 page (date unknown).

Bally Circus Advertisement for excerpt from "Lemons, Cherries and Bell Fruit Gum," Richard M. Bueschel, 3 pages (date unknown).

Bally Bingo Advertisement for excerpt from "Lemons, Cherries and Bell Fruit Gum," Richard M. Bueschel, 1 page (date unknown).

Las Vegas Slot Machine Advertisement for excerpt from "Lemons, Cherries and Bell Fruit Gum," Richard M. Bueschel, 1 page (date unknown).

Website Publication for "Phantom Haus," Williams Electronics Games, Inc., 2 pages (date unknown).

Website Publication for "Arabian Riches," Silicon Gaming Inc., 2 pages (Jul. 17, 1998).

Website Publication for "Buccaneer Gold," Silicon Gaming Inc., 2 pages (Jul. 17, 1998).
Website Publication for "Fort Knox," Silicon Gaming Inc., 2 pages (Jul. 17, 1998).
Website Publication for "Lady of Fortune," Silicon Gaming Inc., 2 pages (Jul. 17, 1998).
Website Publication for "Riddle of the Sphinx," Silicon Gaming Inc., 2 pages (Jul. 17, 1998).
Product Sheet for "Kaleidoscope," Williams Electronics Games, Inc., 3 pages (date unknown).
Product Sheet for "Double Wild & Loose," Williams Electronics Games, Inc., 3 pages (date unknown).
Product Sheet for "Wild Cherry (120A)," International Game Technology, 2 pages (Nov. 7, 1994).
Product Sheet for "Double Wild Cherry (195A)," International Game Technology, 3 pages (Nov. 7, 1994).
Chapters 10, 11 & 12, excerpts from "Lemons, Cherries and Bell–Fruit–Gum," Richard M. Bueschel, 71 pages (1995).
Advertisement for "Club Vegas," Barcrest, 1 page (date unknown).
Advertisement for "Viva Club Vegas!," Barcrest, 1 page (date unknown).
Advertisement for "Monopoly: Maygay There for the Taking," 2 pages (date unknown).
Advertisement for "The Big Breakfast," Channel Four Television Corporation, 2 pages (1993).
Advertisement for "Midas Touch," 2 pages (date unknown).
Advertisement for "Acropolis," Automatic (Fruit) Designs, Ltd., 2 pages (date unknown).
Advertisement for "Adders & Ladders," Barcrest, 2 pages (date unknown).
Advertisement for "The Wild West," Bell–Fruit Manufacturing, 2 pages (date unknown).
Advertisement for "Premier Club Manager," Bell–Fruit Manufacturing, 2 pages (date unknown).
Advertisement for "Fortune Wheel," Project Customer Services, 2 pages (date unknown).
Advertisement for "Road Hog," Barcrest, 2 pages (date unknown).
Advertisement for "Viva! Six! Las Vegas," Barcrest, 2 pages (date unknown).
Advertisement for "Golden Circle," Delta Automaten, 1 page (date unknown).
Advertisement for "Club Double," M–D–M Coin Sales Ltd., 2 pages (date unknown).
Advertisement for "Treasure Island," American Alpha, Inc., 1 page (date unknown).
Advertisement for "Bonus Card," Andries Robert Automatic s.p.r.l., 1 page (date unknown).
Advertisement for "Super Square," Maygay Machines Ltd., 2 pages (date unknown).
Advertisement for "Lucky Bank," 1 page (date unknown).
Advertisement for "Happy Clown," Andries Robert Automatic s.p.r.l., 1 page (date unknown).
Advertisement for "Jackpot Stampede," WMS Gaming Inc., 2 pages (date unknown).
Brochure for "Perfect Universal Slot Machines," Universal Co., Ltd., 16 pages (date unknown).
Advertisement for "Club Make a Million," Bell–Fruit Manufacturing Co., Ltd., 2 pages (date unknown).
Advertisement for "Instant Jackpots," Bell–Fruit Manufacturing Co., Ltd., 2 pages (date unknown).
Cover page, "Enter Disposable Gaming," *Euroslot. The International Coin–Operated Machine Journal*, 1 page (Apr. 1994).
Advertisement for Barcrest Limited, 1 page (date unknown).
Cover page for "Covers Your World," *Euroslot. The Currency of the Coin Machine Industry*, 1 page (date unknown).
Article titled "Bangkok on the Brink," *Euroslot. The International Coin–Operated Machine Journal*, 2 pages (Nov. 1993).
Article titled "Scandinavia on the Brink of the EU melting pot," *Euroslot. The International Coin–Operated Machine Journal*, 2 pages (Aug. 1994).
Advertisement for "Only Fools and Horses," Bell–Fruit Manufacturing Co., Ltd., 2 pages (date unknown).
Advertisement for "Main Attraction," Bell–Fruit Manufacturing Co., Ltd., 2 pages (date unknown).
Brochure for "World Players," Barcrest, 6 pages (date unknown).
Brochure for "JPM Presents MONOPOLY Deluxe," JPM International Ltd., 5 pages (date unknown).
Brochure for "The $50^{th}$ Show," Ate International, 2 pages (Jan. 1994).
Advertisement for "Colossus," AFD, 1 page (date unknown).
Advertisement for "Wheel of Fortune," Project Creating Entertainment, 2 pages (date unknown).
Advertisement for "Lucky Horseshoes," JPM Automatic Machines Ltd., 2 pages (date unknown).
Advertisement for "Lucky Jackpots," JPM Automatic Machines Ltd., 2 pages (date unknown).
Advertisement for "MONOPOLY," JPM Automatic Machines Ltd., 2 pages (date unknown).
Product Sheet for "Batter Up!," Williams Gaming, Inc. (date unknown).

* cited by examiner

GAMING MACHINE WITH PLAYER SELECTED EVENTS

REFERENCE TO RELATED APPLICATIONS

This application is a continuation of U.S. patent application Ser. No. 09/538,934, filed Mar. 31, 2000, now issued as U.S. Pat. No. 6,592,457 which is a continuation-in-part of U.S. patent application Ser. No. 09/318,903, filed May 26, 1999, now issued as U.S. Pat. No. 6,443,837, and U.S. patent application Ser. No. 09/393,492, filed Sep. 10, 1999, now issued as U.S. Pat. No. 6,270,411, and these applications are incorporated by reference in their entirety into the present application.

FIELD OF THE INVENTION

The present invention relates generally to gaming machines and, more particularly, to a gaming machine having player selected events.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning on each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operators. Traditional gaming machines use mechanical slot reels or video depictions of such reels to display games and outcomes to players. Further, many traditional gaming machines use simulations of standard casino games such as cards, dice, bingo and the like to attract players. These traditional machines may become repetitive over time, and it is believed that more innovative displays and gameplay features will find success by offering players an interesting and exciting alternative to traditional games. Accordingly, in the competitive gaming machine industry, there is a continuing need for gaming machine manufacturers to produce new types of games, or enhancements to existing games, which will attract frequent play by enhancing the entertainment value and excitement associated with the game. In particular, there is a need for engaging and entertaining games that can hold a player's interest more than existing games. The present invention is directed to satisfying this need.

SUMMARY OF THE INVENTION

In accordance with one aspect of the present invention; there is provided a gaming machine comprising a presentation medium presenting a multi-stage game including a plurality of stages and a plurality of player-selectable options, each of the stages including an action executed on the presentation medium in response to selection of at least one of the options by a player. The action in at least one of said stages results in a payoff if the action matches predetermined criteria. The game is other than slots, cards, roulette, dice, dominoes, bingo, or keno, and in a preferred embodiment the game is a simulation of a sporting event.

BRIEF DESCRIPTION OF THE DRAWINGS

The foregoing and other advantages of the invention will become apparent upon reading the following detailed description and upon reference to the drawings in which.

Figure 1:
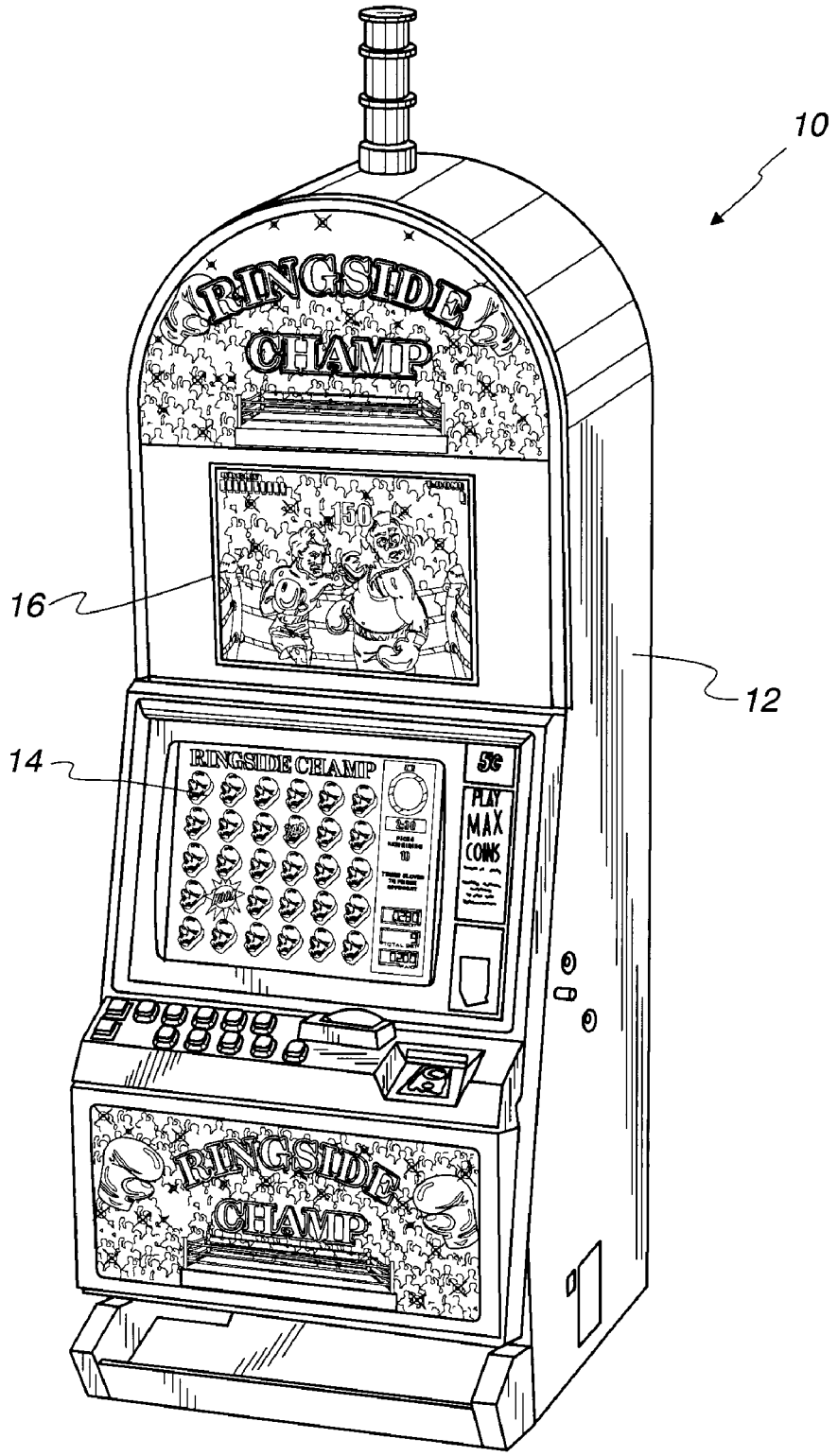
FIG. 1 is a perspective view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, there is depicted a video gaming machine 10 that may be used to implement a game according to the present invention. The gaming machine 10 includes a large bonnet-top cabinet 12 containing two video displays 14 and 16. Each of the video displays 14 and 16 may comprise a dot matrix, CRT, LED, LCD, electro-luminescent display or generally any type of video displays known in the art. One or both of the video displays 14 and 16 may incorporate a touch-screen input device. In the illustrated embodiment, the gaming machine 10 is an "upright" version in which the video displays 14 and 16 are oriented vertically relative to the player. It will be appreciated, however, that any of several other models of gaming machines are within the scope of the present invention including, for example, a single video display and more than two video displays. Furthermore, a "slant-top" version containing the video display(s) that is slanted at about a thirty-degree angle toward the player may be used.

In one embodiment, the gaming machine 10 is operable to play a game entitled RINGSIDE CHAMP™ having a boxing theme. In another embodiment, the gaming machine 10 is operable to play a game having a football theme. In alternative embodiments, the gaming machine 10 may provide different games and/or any of several alternative game themes. The RINGSIDE CHAMP™ game features a basic game with player selected events in the form of a boxing match (see FIGS. 3*a* and 3*b*). The RINGSIDE CHAMP™ game may also include a bonus game or secondary game.

Figure 2:
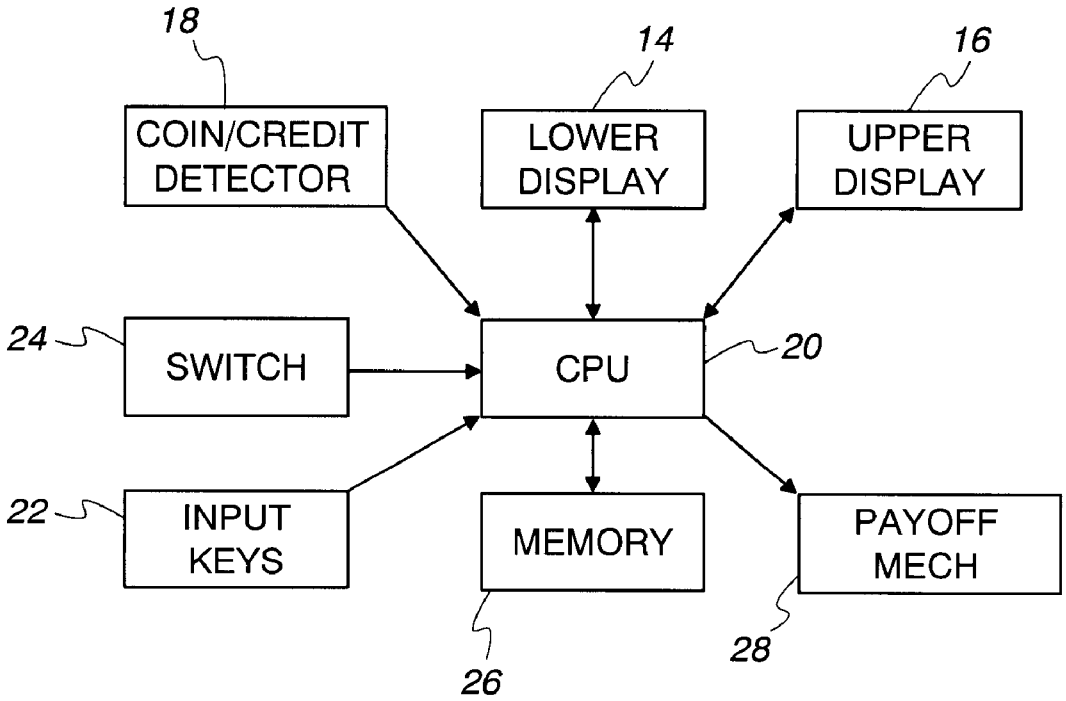
FIG. 2 is a block diagram of a control system suitable for operating the gaming machine in FIG. 1.

FIG. 2 is a block diagram of a control system including processing circuitry suitable for operating the gaming machine 10. Coin/credit detector 18 signals a CPU 20 when a player has inserted a number of coins or played a number of credits. Then, the CPU 20 operates to execute a game program which causes the lower video display 14 to display the basic game that includes a series of player selectable options displayed thereon (see FIGS. 3*b* and 4*b*). The player may select the amount to wager via an input key 22. A play of the game commences in response to the player activating a switch 24 corresponding to a displayed option (e.g., by pushing a button or touching a touch screen), causing the CPU 20 to randomly select a game outcome and animate the game outcome on the upper display 16. Animation may take any of several forms; for example, the animation may be hand-drawn animation showing an action, computer animated action, video or film representations, or any other visible movement corresponding to a selected option. In one embodiment, the game outcome may be displayed via mechanical devices which carry out an action in response to the player's selection of an option. In addition, the depiction of the outcome of an option selected by a player may be displayed using a combination of these forms of animation. In one embodiment, certain of the basic game outcomes cause the CPU 20 to enter a bonus mode causing the video displays 14 and 16 to show a bonus game.

A system memory 26 stores control software, operational instructions and data associated with the gaming machine 10. In one embodiment, the memory 26 comprises a separate read-only memory (ROM) and battery-backed random-access memory (RAM). However, it will be appreciated that the system memory 26 may be implemented on any of several alternative types of memory structures or may be implemented on a single memory structure. A payoff mechanism 28 is operable in response to instructions from the CPU 20 to award a payoff of coins or credits to the player in response to certain winning situations which might occur in the game. The payoff amounts corresponding to certain outcomes in the basic game are predetermined according to a pay table stored in system memory 26. The payoff amounts corresponding to certain outcomes of the bonus game are also stored in system memory 26. Furthermore, the system memory 26 stores data relating to the images to be shown on the lower and upper displays 14 and 16.

Figure 3A:
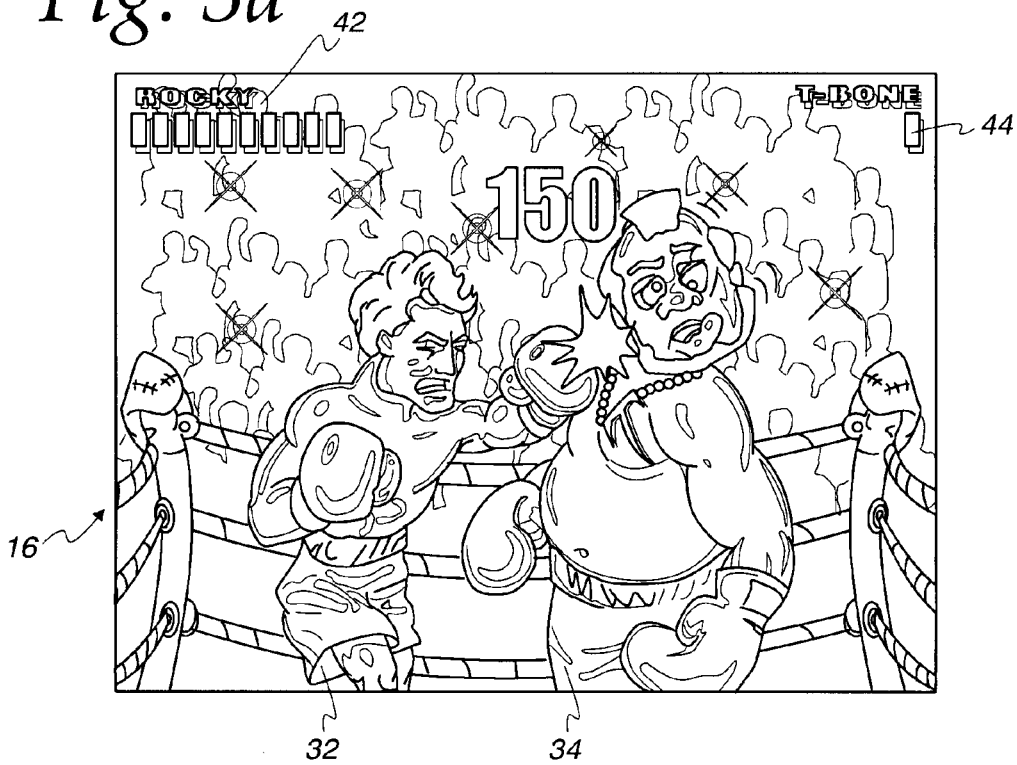
FIGS. 3*a* and 3*b* are display screen captures associated with a boxing game that is played on the gaming machine in FIG. 1.
Figure 3B:
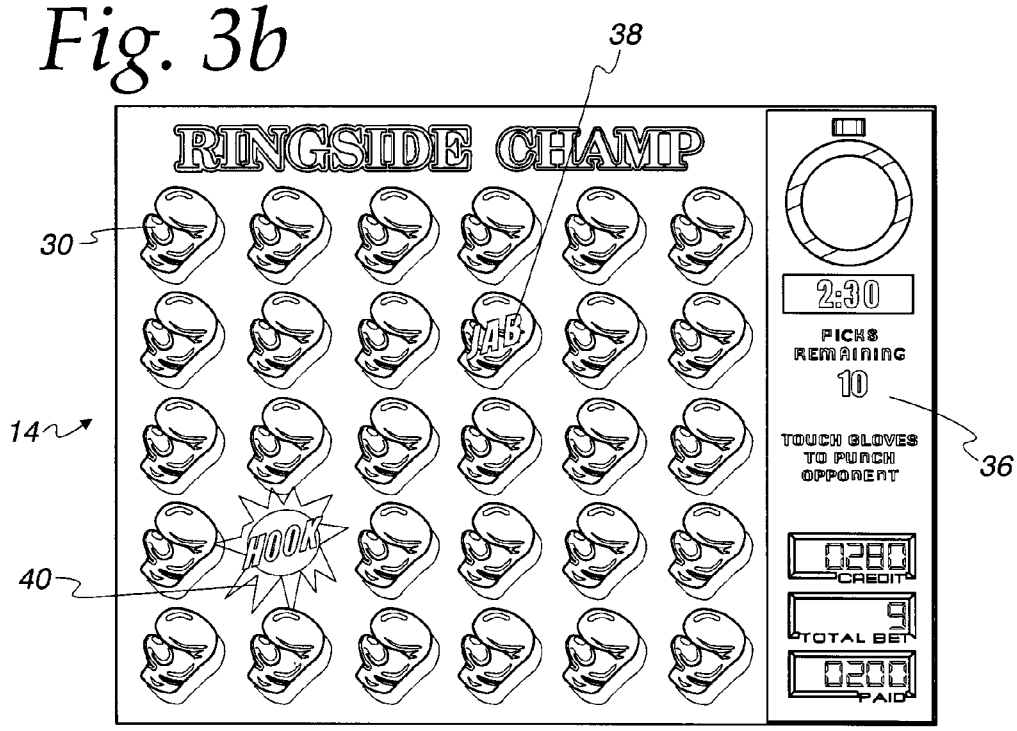

As shown in FIGS. 3*a* and 3*b*, the RINGSIDE CHAMP™ basic game is implemented on the video displays 14 and 16. As illustrated in FIG. 3*b*, the lower display 14 presents an array of boxing gloves 30. As illustrated in FIG. 3*a*, the upper display presents an animation of a boxing match with two boxers "Rocky" 32 and "T-Bone" 34. Generally, game play is initiated by inserting a number of coins or playing a number of credits, causing the CPU 20 (FIG. 2) to activate a number of picks available to the player corresponding to the number of coins or credits played. The lower display 14 illustrates the number of picks 36 or selections available to the player.

After picks 36 are made available to the player, the lower display 14 informs the player "TOUCH GLOVES TO PUNCH OPPONENT." The CPU 20 uses a random number generator (not shown) to select a punch type for each of the displayed gloves 30 (player selectable options). In one embodiment, the punch type for each glove 30 is written over the gloves 30 as shown by the "JAB" glove 38. For convenience, this embodiment is called the options revealed embodiment. In another embodiment, a punch type or outcome for each glove is not revealed until the player selects a glove such as the revealed "HOOK" glove 40. For convenience, this embodiment is called the options hidden embodiment. For both the options revealed and options hidden embodiments, the player selects one of the boxing gloves 30 (i.e., a player selectable option). In one embodiment, the lower display 14 includes a touch screen to allow the player to press the desired boxing glove 30.

In the options revealed embodiment, once the player selects one of the boxing gloves 36, the selected option animates on the upper display 16. For the example illustrated in FIGS. 3*a* and 3*b*, the JAB option 38 has been selected and ROCKY throws a jab punch. The CPU 20 randomly determines a punch outcome for the selected JAB the player's selection of an option and its outcome represent a stage of the game. Each stage of the game can result in a stage payoff dependent on the stage outcome that results from the action. The punch outcome is a result for the thrown punch having a payoff, such as a missed punch equaling no payoff, a blocked punch equaling no payoff, a soft hit equaling 10 credits, a medium hit equaling 50 credits, a solid hit equaling 150 credits, a knock down equaling 250 credits and a knock out equaling 500 credits. For example, the JAB punch may result in the solid hit as animated on the upper display 16 in FIG. 3*a* with the JAB punch connecting with the face of T-Bone resulting in a 150 credit payoff to the player. Table 1 illustrates a pay table for the RIINGSIIDE CHAMP™ basic game. In the options revealed embodiment, the punches are shown to the player before the player's selection, but the outcomes of the punches are randomly determined following the player's selection.

TABLE 1

Pay Table for Options Revealed Embodiment

| PUNCH OUTCOME | PAYOFF |
|---|---|
| MISSED PUNCH | 0 |
| DEFLECTED PUNCH | 0 |
| SOFT HIT | 10 |
| MEDIUM HIT | 50 |
| SOLID HIT | 150 |
| KNOCK DOWN | 250 |
| KNOCK OUT | 500 |

The options hidden embodiment is similar to the options revealed embodiment. Once the player selects one of the boxing gloves 36 (player selectable options), the selected boxing glove animates on the lower display 14 revealing either a punch type, such as HOOK 40 in FIG. 3*b*, or an outcome for the selected boxing glove. If a punch type is revealed, the CPU 20 determines a punch outcome for the revealed punch type, such as the HOOK punch 40. The punch outcome is a result for the thrown punch having a payoff value, such as a missed punch equaling no payoff, a deflected punch equaling no payoff, a soft hit equaling a small payoff, a medium hit equaling a medium payoff, or a solid hit equaling a large payoff. For example, the HOOK punch may result in the solid hit as animated on the upper display 16 in FIG. 3*a* for the JAB punch resulting in a 150 credit payoff to the player. Just as for the options revealed embodiment, the action resulting from the player's selection of an option and its outcome, represent a stage of the game. Likewise, each stage of the game can result in a stage payoff dependent on the stage outcome that results from the action.

In the options hidden embodiment, the punches or outcomes corresponding to the boxing gloves may be randomly determined before the player selects a boxing glove 30. Alternatively, the punches or outcomes corresponding to the boxing gloves may be randomly determined after the player selects a boxing glove 30. In one embodiment, all of the hidden punches, defensive moves, and/or punch outcomes may be displayed after the player selects one of the boxing gloves.

For both the options revealed embodiment and the options hidden embodiment, the upper display 16 presents a score card 42 for ROCKY and a score card 44 for T-BONE which can be used to record the stage outcome for each stage of the game. In one embodiment, the score cards 42 and 44 track and illustrate the punch outcomes for the player.

In another embodiment, the score cards reflect the energy or power remaining for the player and the opponent. In this embodiment, the game may pause when ROCKY's score card 42 is depleted to zero to allow the player to place a new wager and increase ROCKY's score card. Further, in this embodiment some boxing gloves may be associated with block or dodge moves that allow the player to avoid getting hit and losing energy or power. Using this embodiment, the player may decide whether to play offensively or defensively to arrive at the best outcome. Following the player's selection of a boxing glove and the machine's depiction of the outcome, the boxing match illustrated on the upper display 16 continues allowing the player to select another boxing glove 30. The punch outcome of the selected boxing gloves 30 is reflected on the score cards 42 and 44. Thus, the boxing match becomes a continuing gameplay experience in which the player participates. As the gameplay experience continues, a connecting punch may result in a knockdown or a knockout, in which case bonus payoffs may be rewarded in addition to the payoffs for connecting punches.

The actions in said stages relate to one another to form a continuing performance that produces a game outcome. The overall, or game outcome, results from combining the stage outcomes for each stage of the game. Players may wager on these game outcomes.

In one embodiment of the RINGSIDE CHAMP™ game, the player can be given the option to place wagers on multiple events or achievements within the boxing game. For example, a player may place bets on who will win the bout, the outcome of the bout (for example, a knockout, a TKO, or a decision), the number of punches that are thrown or that land in a bout, and the like. These wagers may be placed at the beginning of the RINGSIDE CHAMP™ game or after the game has begun. These wagers reflect the overall, or game outcome, that results from each stage of the game.

Figure 5:
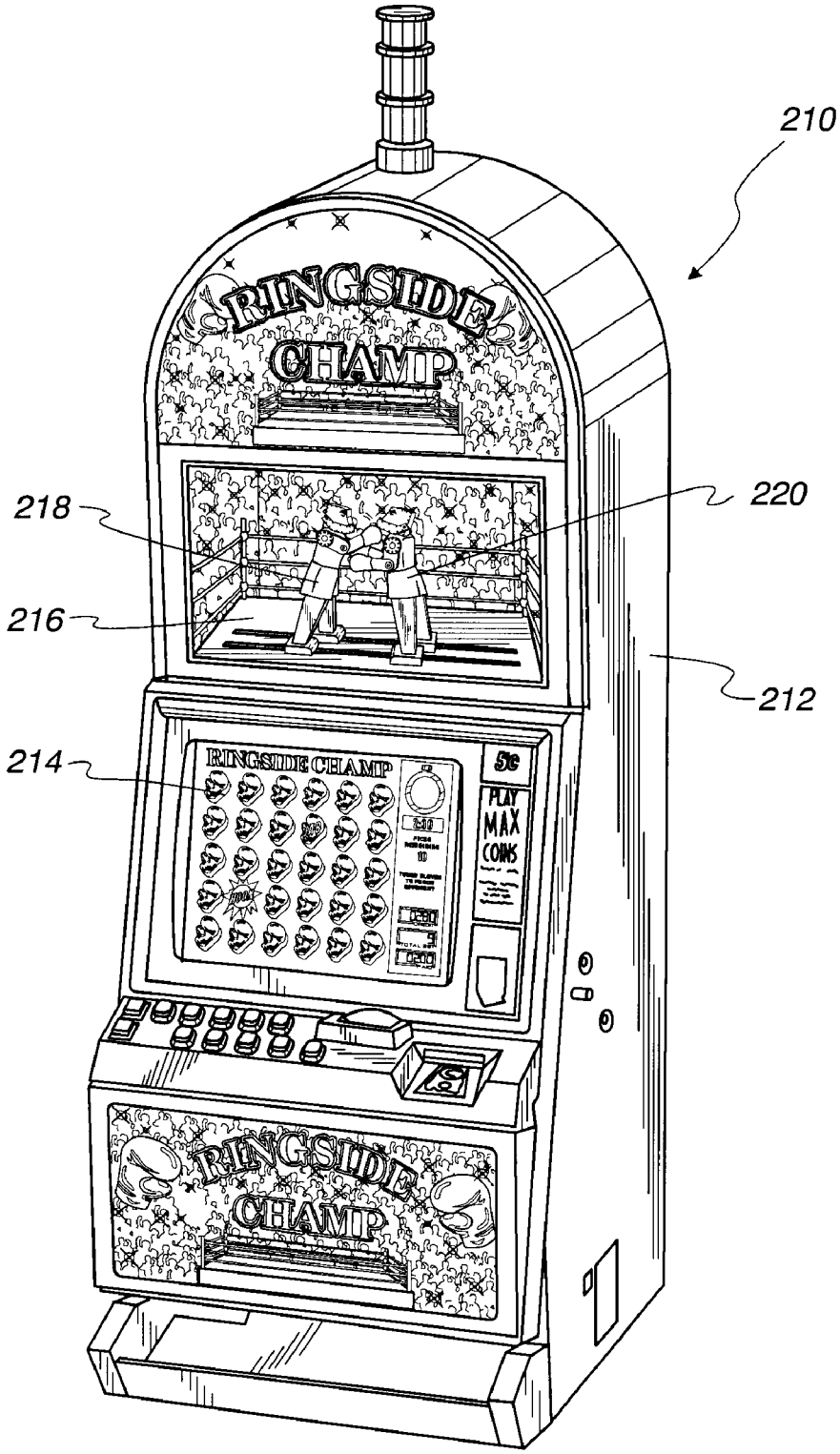
FIG. 5 is a perspective view of a gaming machine for playing one embodiment of the present invention.

Further, in addition to being shown on an upper display 16, the outcomes of selections by a player and the progression of the present invention may be shown via mechanical devices as illustrated in FIG. 5. In this embodiment the gaming machine 210 has a stand-up cabinet 212 with a lower display 214 and an upper mechanical display 216. In the RINGSIDE CHAMP™ embodiment, a mechanical actor representing the player 218 and a mechanical actor representing the opponent 220 provide a physical representation of the outcomes and progression of the game as selected by the player. The mechanical display could further be used in other embodiments, where the mechanical display may depict vehicles, teams, or other objects.

Figure 4A:
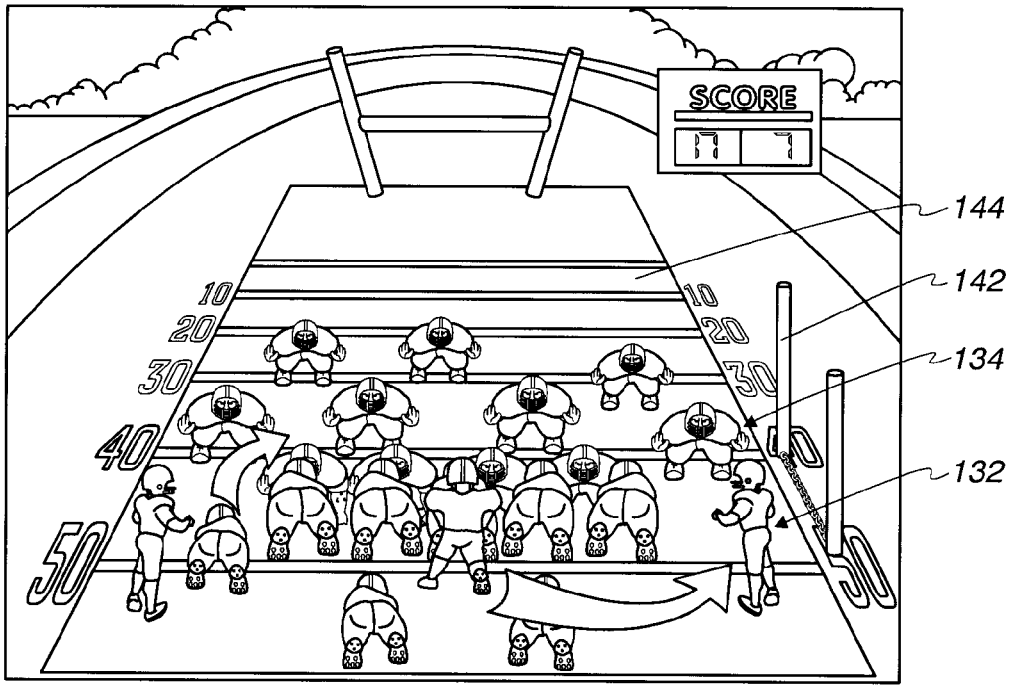
FIGS. 4*a* and 4*b* are display screen captures associated with a football game that is played on the gaming machine in FIG. 1.
Figure 4B:
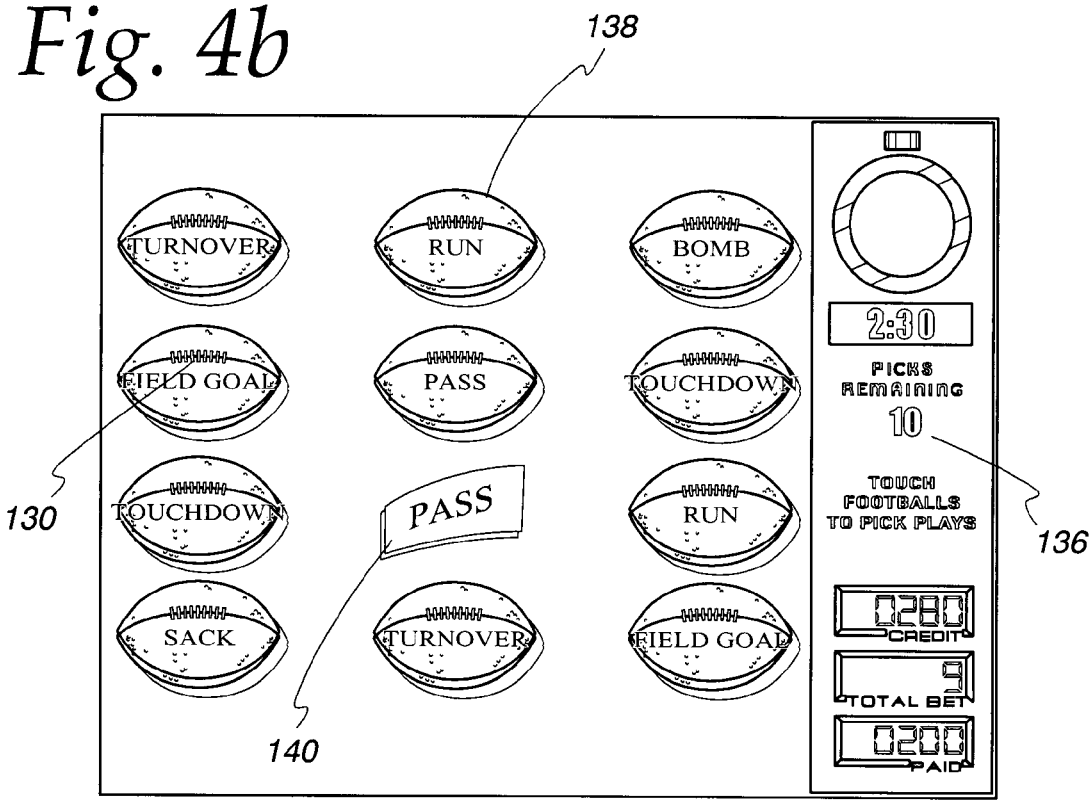

In another embodiment, the gaming machine 10 is operable to play a game entitled "football" having an American football theme. As shown in FIGS. 4*a* and 4*b*, the football basic game is similarly implemented on the video displays 14 and 16 as the RINGSIDE CHAMP™ game. As illustrated in FIG. 4*b*, the lower display 14 presents an array of footballs 130. As illustrated in FIG. 4*a*, the upper display presents an animation of a football game with two teams "Home" 132 and "Visitor" 134. Generally, game play is initiated by inserting a number of coins or playing a number of credits, causing the CPU 20 (FIG. 2) to activate a number of picks available to the player corresponding to the number of coins or credits played. The lower display 14 illustrates the number of picks 136 or selections available to the player.

After picks 136 are made available to the player, the lower display 114 informs the player "TOUCH FOOTBALLS TO PICK PLAYS." The CPU 20 uses a random number generator (not shown) to select a play type for each of the displayed footballs 130 (representing player selectable options). In one embodiment, the play type for each football 130 is written over the football 130 as shown by the "RUN" football 138. For convenience, this embodiment is called the options revealed embodiment. In another embodiment, the play type or outcome for each football is not revealed until the player selects that football such as the revealed "PASS" football 140. For convenience, this embodiment is called the options hidden embodiment. For both the options revealed and options hidden embodiments, the player selects one of the footballs 130 (player selectable options). In one embodiment, the lower display 14 is a touch screen to allow the player to press the desired football 130.

In the options revealed embodiment, once the player selects one of the footballs 130, the selected option animates on the upper display 16. The action resulting from the player's selection of an option and its outcome represent a stage of the game. Each stage of the game can result in a stage payoff dependent on the stage outcome that results from the action.

For the example illustrated in FIGS. 4*a* and 4*b*, the RUN option 138 has been selected and the HOME team executes a run play. This is an example of a single stage of this multistage game. The CPU 20 randomly determines a play outcome for the selected RUN option 138. Each stage of the game can result in a stage payoff dependent on the outcome of the action. The play outcome is a result for the executed play having a payoff value, such as a loss of yardage equaling no payoff, no gain equaling no payoff, short gain equaling a small payoff, a long gain equaling a medium payoff, and a touchdown equaling a large payoff. For example, the RUN play may result in the short gain as animated on the upper display 16 in FIG. 4*a* providing a 10 credit payoff to the player. Table 2 illustrates a pay table for the football basic game.

TABLE 2

Pay Table for Options Revealed Embodiment

| PLAY OUTCOME | PAYOFF |
|---|---|
| LOSS OF YARDAGE | 0 |
| NO GAIN | 0 |
| SHORT GAIN | 10 |
| MEDIUM GAIN | 50 |
| LONG GAIN | 150 |
| FIELD GOAL | 250 |
| TOUCHDOWN | 500 |

The options hidden embodiment is similar to the options revealed embodiment, except that the player selectable options are hidden until selected. Once the player selects one of the footballs 130, the selected football animates on the lower display 14 revealing the play or play outcome, such as PASS 140 in FIG. 4*b*. The action resulting from the player's selection of an option and its outcome represent a stage of the game.

In the options hidden embodiment, the plays or play outcomes may be randomly determined by the CPU 20 either before the player selects a football 130 or after the player selects a football 130. In the current example, the CPU 20 randomly determines a play outcome for the selected PASS option 140. Alternatively, in the options hidden embodiment, the CPU 20 could randomly choose a play outcome such as "TOUCHDOWN" to correspond to a football 130.

Each stage of the game can result in a payoff dependent on the outcome of the action. The play outcome is a result for the executed play having a payoff value, such as a loss of yardage equaling no payoff, no gain equaling no payoff, short gain equaling small payoff, a long gain equaling a medium payoff, and a touchdown equaling a large payoff. For example, the PASS play may result in the long gain resulting in a 150 credit payoff to the player. In one embodiment, all of the hidden plays andlor play outcomes may be displayed after the player selects one of the footballs.

In one embodiment, the footballs 130 initially correspond to football formations. In this embodiment, when a player selects a formation the footballs 130 alter so that they correspond to individual plays using the selected formation. This embodiment may be employed with either offensive or defensive plays. Further, schematic diagrams of a play choice may be displayed.

In addition to the RINGSIDE CHAMP™ and football games described above, the present invention may be implemented in connection with a wide variety of a lifelike representations of other sports, such as, for example, baseball, hockey, basketball, soccer, tennis, automobile or horse racing, golf, track-and-field, or bowling events. In all embodiments, the game selected is other than slots, cards, roulette, dice, dominoes, bingo, or keno.

The actions in said stages relate to one another to form a continuing performance that produces a game outcome. The overall, or game outcome, results from combining the stage outcomes for each stage of the game. Players may wager on these game outcomes.

In one embodiment, in addition to the wager and play features described above, the player may place optional wagers on overall outcomes of a continuing gameplay experience. For example, in the RINGSIDE CHAMP™ game, a player may be able to wager on such outcomes as who will win a bout, how many punches each competitor with throw or land, and the overall number of rounds in the bout. Likewise, in the football game, a player may be able to wager on such outcomes as the winner of the game, the margin of victory, the points scored by each team or the teams combined, the overall yardage gained or lost by each team, pass completion percentage, and other such statistics. Thus, the predetermined criteria for awarding a payoff based on the game outcome may be established by the player.

Optional wagers may be placed at the same time as the wagers that start the game, or they may be placed during the game so as to alter the possible payoffs resulting from the outcomes. Different wagers may be accepted based on the complexity of the game desired by the player; if a player desires a very complex game with many statistics to wager on, many different optional wagers may be accepted. Alternatively, a player may wish only to play a simple play with no wagers other than the basic wagers used to play the game, and therefore the game will be limited to accepting less complex wagers.

In one embodiment of the present invention, a large jackpot may be provided to players who achieve an especially rare accomplishment in the game. For example, in the RINGSIDE CHAMP™ game, a large jackpot can be awarded if the player achieves a first-round knockout. Similarly, in the football game, a large jackpot can be awarded if the player scores an unusually high point total or if the player keeps the opposing team from scoring any points.

In another embodiment of the present invention, a player may pause a game before the conclusion of the game. In this embodiment, the player may use a casino identification number identifying the player to the gaming machine, a magnetic card, a smart card, or any other memory device to record the status of the game when the player chooses to pause. The game may be paused at any time the player wishes. Then, when the player wants to resume the game, the player may input the identification number or memory device into the gaming machine. The gaming machine then links the player's identification information or the information contained on the memory device to the last status of the paused game. Using this embodiment, the player may play an entire football game or boxing match, for example, without having to stay at the machine the entire time, and without having to return to the same machine in the future to conclude the game. This embodiment could further be used, for example, for a player to simulate a season in football, baseball, or any other team sport or a career in boxing, tennis, or any other individual sport. Further, in sports such as horse racing and auto racing, this embodiment could be used to allow the player to build up a stable of horses or a team of automobiles that would be managed over time by the player. Thus, in addition to the payoffs granted by the machine, the player may build up status on the game over time, and these status improvements may be used by casino operators to grant special bonuses.

While the present invention has been described with reference to one or more particular embodiments, those skilled in the art will recognize that many changes may be made thereto without departing from the spirit and scope of the present invention. For example, the basic game may itself be implemented on the video display 12 or on a separate video display. Further, though the present invention has been described as an entire game, those skilled in the art will recognize that the invention could also be implemented as a bonus game for known types of gaming machines. In addition, though the present invention has been described with respect 'to the portrayal of simulated sporting events, the invention is not limited to portraying simulated sporting events and includes the portrayal of other types of events and actions. Further, though specific embodiments have been described having two displays, the invention may be implemented on machines having only one display and may also be implemented on machines having more than two displays. Each of these embodiments and obvious variations thereof is contemplated as falling within the spirit and scope of the claimed invention, which is set forth in the following claims.

What is claimed is:

1. A gaming machine for playing a multi-stage game, said gaming machine comprising:

a credit detector for accepting a wager to initiate a play of said multi-stage game;

a central processing unit for controlling said multi-stage game, said multi-stage game including a plurality of stages, each stage having a plurality of player selectable options, each player selectable option associated with a plurality of stage outcomes;

an input device for receiving a selection of one of the plurality of player selectable options for each stage;

said central processing unit further for randomly selecting one of said plurality of stage outcomes associated with the one of said plurality of player selectable options for each stage, and associating an animated performance with the selected said player selectable option and the selected said stage outcome for each stage;

a game display controlled by said central processing unit for displaying said animated performance associated with each stage;

said central processing unit further for determining an overall game outcome from said stage outcomes; and a payout device for awarding a payoff if said overall game outcome satisfies predetermined criterion.

2. The gaming machine of claim 1, wherein said central processing unit further selects said animated performance from a plurality of animated performances.

3. The gaming machine of claim 1, wherein the final said stage outcome determines said overall game outcome.

4. The gaming machine of claim 1, wherein said overall game outcome is a function of each stage outcome.

5. The gaming machine of claim 1, wherein said payout device awards a stage payoff for each stage outcome that satisfies predetermined criterion.

6. The gaming machine of claim 5, wherein said stage payoff is based on a degree of success of said stage outcome.

7. The gaming machine of claim 1, wherein said stage outcome occurs after a stage wager is placed.

8. The gaming machine of claim 1, wherein said multi-stage game includes a sporting event.

9. The gaming machine of claim 8, wherein said sporting event is selected from a group consisting of football, boxing, basketball, baseball, hockey, soccer, racing, track-and-field, golf, tennis, and bowling.

10. The gaming machine of claim 8, wherein each animated performance includes a play of said sporting event.

11. The gaming machine of claim 1, wherein said animated performance in each stage varies from said other stages.

12. The gaming machine of claim 1, wherein said animated performance in each of said stages varies with the selection of different ones of said player selectable options.

13. The gaming machine of claim 1, wherein said animated performance in each of said stages continues said animated performance occurring in an immediately preceding one of said stages.

14. The gaming machine of claim 1, wherein said animated performance in each said stage relates to an immediately preceding said stage outcome.

15. A method of conducting a multi-stage wagering game on a gaming machine comprising:

receiving a wager from a player;

selecting a first option from a plurality of options associated with a first stage of the game;

determining randomly a first stage outcome from a plurality of stage outcomes associated with the selected first option;

presenting a first stage outcome as a first animated performance;

selecting a second option from a plurality of options associated with a second stage of the game;

determining randomly a second stage outcome from a plurality of stage outcomes associated with the selected second option;

presenting the second stage outcome as a second animated performance;

determining an overall game outcome from the stage outcomes; and awarding the player for the overall game outcome that satisfies predetermined criterion.

16. The method of conducting a multi-stage wagering game as described in claim 15, wherein the overall game outcome is a function of each stage outcome.

17. The method of conducting a multi-stage wagering game as described in claim 15, wherein the overall game outcome is determined by the second stage outcome.

18. The method of conducting a multi-stage wagering game as described in claim 15, wherein the player is awarded a stage payoff for each stage outcome that satisfies predetermined criterion.

19. The method of conducting a multi-stage wagering game as described in claim 18, wherein the stage outcome occurs after a stage wager is placed.

20. The method of conducting a multi-stage wagering game as described in claim 18, wherein the stage payoff is based on a degree of success of the stage outcome.

21. The method of conducting a multi-stage wagering game as described in claim 15, wherein the second stage relates to the first stage outcome.

22. The method of conducting a multi-stage wagering game as described in claim 15, wherein the animated performance is a function of the selected option and the randomly determined stage outcome.

23. The method of conducting a multi-stage wagering game as described in claim 15, wherein the animated performance in the second stage continues the action occurring in the first stage.

24. A method of conducting a wagering game on a gaming machine comprising:

presenting a continuing animated performance, including a plurality of linked stages such that one stage progresses the animated performance from an immediate prior stage;

for each stage, receiving a selection from a player of an option from a plurality of player selectable options, the player selectable options being other than a wager amount; and randomly selecting a stage outcome from a plurality of stage outcomes, the plurality of stage outcomes associated with the option selection from the player; and determining an overall game outcome from the stage outcomes.

25. The method of conducting a wagering game as described in claim 24, wherein the overall game outcome is a function of each stage outcome.

26. The method of conducting a wagering game as described in claim 24, wherein the overall game outcome is determined by the final stage outcome.

27. The method of conducting a wagering game as described in claim 24, wherein the player is awarded with a stage payoff for each stage outcome that satisfies a predetermined stage criterion.

28. The method of conducting a wagering game as described in claim 27, wherein each stage outcome occurs after a stage wager is placed by the player.

29. The method of conducting a wagering game as described in claim 27, wherein the stage payoff is based on a degree of success of the stage outcome.

30. The method of conducting a wagering game as described in claim 24, wherein the animated performance progresses in each succeeding stage regardless of the stage outcome in the prior stage.

31. The method of playing a wagering game as described in claim 24, further including making a wager on at least one stage outcome, and awarding the player for a winning outcome on the wagered stage.

32. The method of playing a wagering game as described in claim 24, wherein the animated performance for each stage is determined by the selected option and the randomly determined stage outcome for each stage.

* * * * *